United States Patent [19]

Sonderby

[11] Patent Number: 4,846,248

[45] Date of Patent: Jul. 11, 1989

[54] STRAP WINDER, IN PARTICULAR FOR SKYLIGHT ROLLER BLINDS

[75] Inventor: Svend A. Sonderby, Videbaek, Denmark

[73] Assignee: V. Kann Rasmussen Industri A/S, Soborg, Denmark

[21] Appl. No.: 197,469

[22] Filed: May 23, 1988

[30] Foreign Application Priority Data

May 26, 1987 [DE] Fed. Rep. of Germany ..... 3717680

[51] Int. Cl.[4] ..... E06B 9/20

[52] U.S. Cl. ..... 160/319; 160/188; 160/193; 160/307; 160/314; 242/107

[58] Field of Search ..... 160/120, 188, 192, 193, 160/307, 314, 319; 242/107

[56] References Cited

U.S. PATENT DOCUMENTS

| | | | |
|---|---|---|---|
| 699,770 | 5/1902 | Stephens | 160/314 X |
| 4,347,885 | 9/1982 | von Knorring et al. | 160/307 X |
| 4,492,261 | 1/1985 | Chong | 160/319 |
| 4,610,293 | 9/1986 | Weiblen | 160/120 |

FOREIGN PATENT DOCUMENTS

| | | | |
|---|---|---|---|
| 2655581 | 6/1978 | Fed. Rep. of Germany | 160/319 |
| 2835370 | 2/1980 | Fed. Rep. of Germany | 160/188 |
| 2847127 | 5/1980 | Fed. Rep. of Germany | 160/193 |
| 8435275 | 12/1984 | Fed. Rep. of Germany . | |

*Primary Examiner*—Ramon S. Britts
*Assistant Examiner*—David G. Kolman
*Attorney, Agent, or Firm*—Majestic, Parsons, Siebert & Hsue

[57] ABSTRACT

The strap winder has a base plate (1) with a recessed grip (2) which is arranged laterally alongside the usual spring-tensioned strap drum (11) and through which the pulling strap (3) passes transversely, the pulling strap running from the device to be operated via a strap clamping device to the recessed grip and from the latter via deflection rollers to the strap drum, so that the strap winder can, due to its relatively flat design, be fitted countersunk in a thin-walled lintel surface above a skylight and thus allowing for more convenient operation.

6 Claims, 2 Drawing Sheets

STRAP WINDER, IN PARTICULAR FOR SKYLIGHT ROLLER BLINDS

This invention relates to a strap winder, in particular for skylight roller blinds, having a strap drum pretensioned by spring force in winding direction for a pulling strap running through a first strap opening and having a strap clamping device arranged close to the first strap opening, the strap drum being rotatably mounted on on the rear of a base plate about an axis of rotation substantially perpendicular to the latter.

In the known strap winders of this type, for example as described in German Utility Model 8,435,275, the strap drum is rotatably mounted between two plates of a compartment-like housing, which is installed in a deep recess of the wall alongside the window in such a way that the axis of rotation of the strap drum runs parallel to the wall surface and the pulling strap runs from the strap drum via a strap clamping device in the housing and a housing opening over the wall surface to a remote passage opening to the roller blind. However, this construction is not suitable for skylights, alongside which there is usually not a sufficiently thick wall available. Although such strap winders have also already been fitted freely projecting on the frame of the skylight, this requires the provision of a strap slot in the frame, which can only be sealed off with difficulty, and hinders the operation of the roller blind when the window casement is open.

The object of the invention is to create a strap winder of the type mentioned at the beginning which, with a simple construction which is uncomplicated to produce, is suitable for installation on skylights and allows convenient operation. For this purpose, it is intended to have the smallest possible installation depth.

To achieve this object, according to the invention, the strap winder of the said type is provided with the features of patent claim 1.

The recessed grip, which is fitted laterally alongside the strap drum in a base plate and through which the pulling strap passes, makes the strap winder so flat overall that it can, without any difficulties, be installed countersunk in the thin-walled lintel area above a skylight or in the lintel board of a skylight lining, resulting in not only convenient operation but also a very short length of the pulling strap, so that the strap drum only requires small dimensions.

Advantageous further developments of the strap winder are described in the subclaims.

The strap winder according to the invention is suitable in particular for the skylight roller blinds described in the Applicant's German Patent Application P 37 17 681.1-25 of the same application date, in which the pulling strap is deflected in such a way from the strap drum connected to the winding shaft of the roller blind, by strap deflecting elements arranged in the roller blind compartment, that it is fed through a strap opening, remote from the strap drum in longitudinal direction of the winding shaft, in the outer cover of the frame upper piece, between the latter and a cover part engaging underneath the outer covering of the latter, directly to the strap winder installed in the lintel area or a lining above the skylight. The strap winder can, however, also be used for skylight roller blinds in which the strap opening in the outer covering of the frame upper piece is opposite the strap drum in the roller blind compartment.

A preferred embodiment of the strap winder is further explained below with reference to the enclosed drawings, in which.

Figure 2:
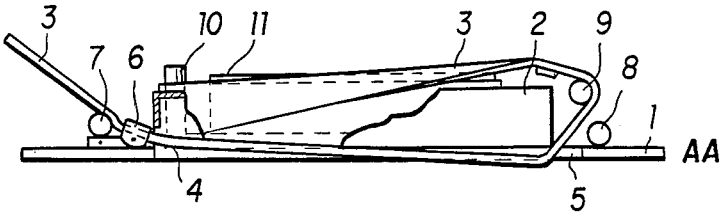
FIG. 2 shows a diagrammatic longitudinal section along the line A—A of FIG. 1
Figure 1:
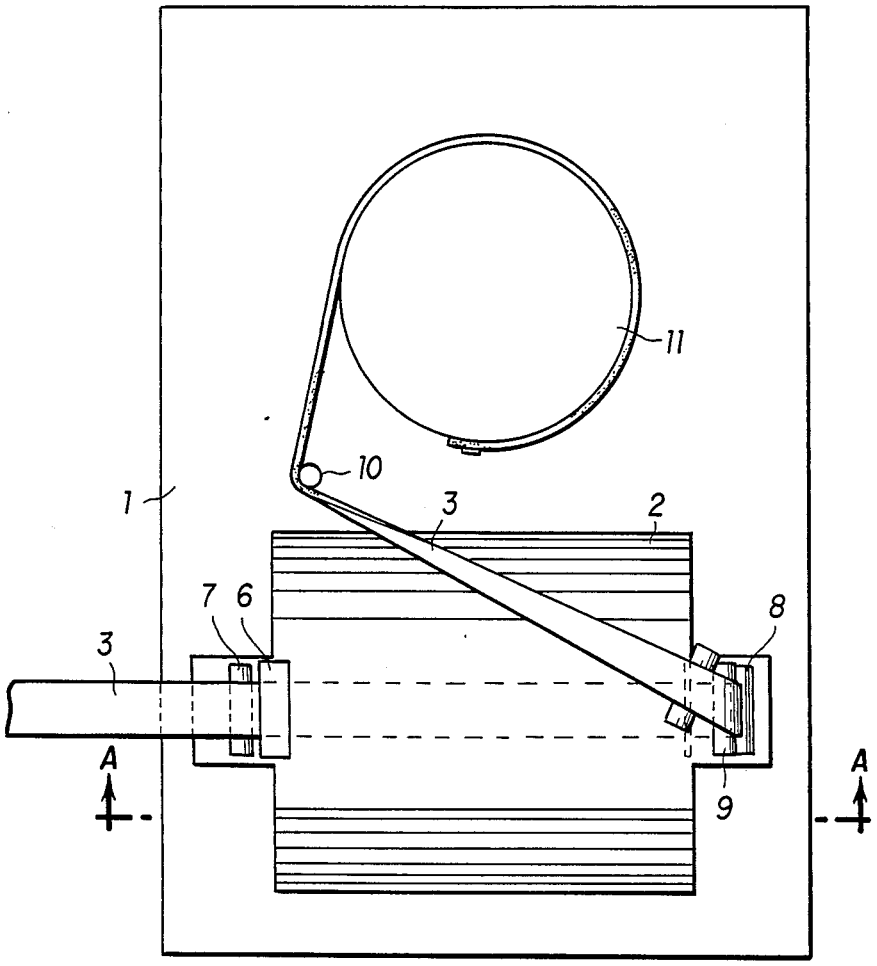
FIG. 1 shows a diagrammatic plan view of the rear of the strap winder.

The strap winder represented in FIGS. 1 and 2 has a flat base plate 1 with a recessed grip 2 of plastic press-fitted in a rectangular opening of the base plate. On opposite sides of the recessed grip 2 there are provided strap openings 4 and 5 for the pulling strap 3, which passes transversely through the recessed grip 2. On the rear of the base plate 1 there is fitted in front of the strap opening 4 a strap clamping device 6 with a strap guide roller 7 arranged ahead of it. On the other side of the recessed grip 2, two strap deflection rollers 8 and 9 are rotatably mounted on the rear of the base plate 1. The base plate 1 also bears on its rear a strap drum 11, which is rotatably mounted laterally alongside the recessed grip 2 and pretensioned in winding direction in a conventional way by a spring device. The pulling strap 3 runs from the strap drum 11 via a strap deflection roller 10, rotatably mounted between the latter and the recessed grip 2, and then with axial strap twisting obliquely over the facing convexity of the recessed grip 2, through between the deflection rollers 9 and 8 and then through the strap opening 5 transversely through the recessed grip 2 to the strap opening 4, whence it runs through the strap clamping device 6 via the strap guide roller 7 for example to the strap drum of a roller blind (not shown).

The arrangement of the strap drum 11 laterally alongside the recessed grip 2 and the guidance of the pulling strap 3 on the one hand transversely over the recessed grip 2 and on the other hand obliquely over its rear convexity make the strap winder so flat overall that it can, without any difficulties, be installed countersunk in the thin-walled lintel area above a skylight or in the lintel board of a skylight lining, the recessed grip 2 at the same time allowing for convenient operation of the pulling strap 3.

In the embodiment represented, the strap clamping device 6 consists of a U-shaped clamping part which embraces the pulling strap 3 and is pivotally mounted on a second clamping part swivel-mounted on the base plate 1, the swivel axes of these clamping parts forming a virtually right-angled triangle with the axis of rotation of the strap guide roller 7.

Figure 3:
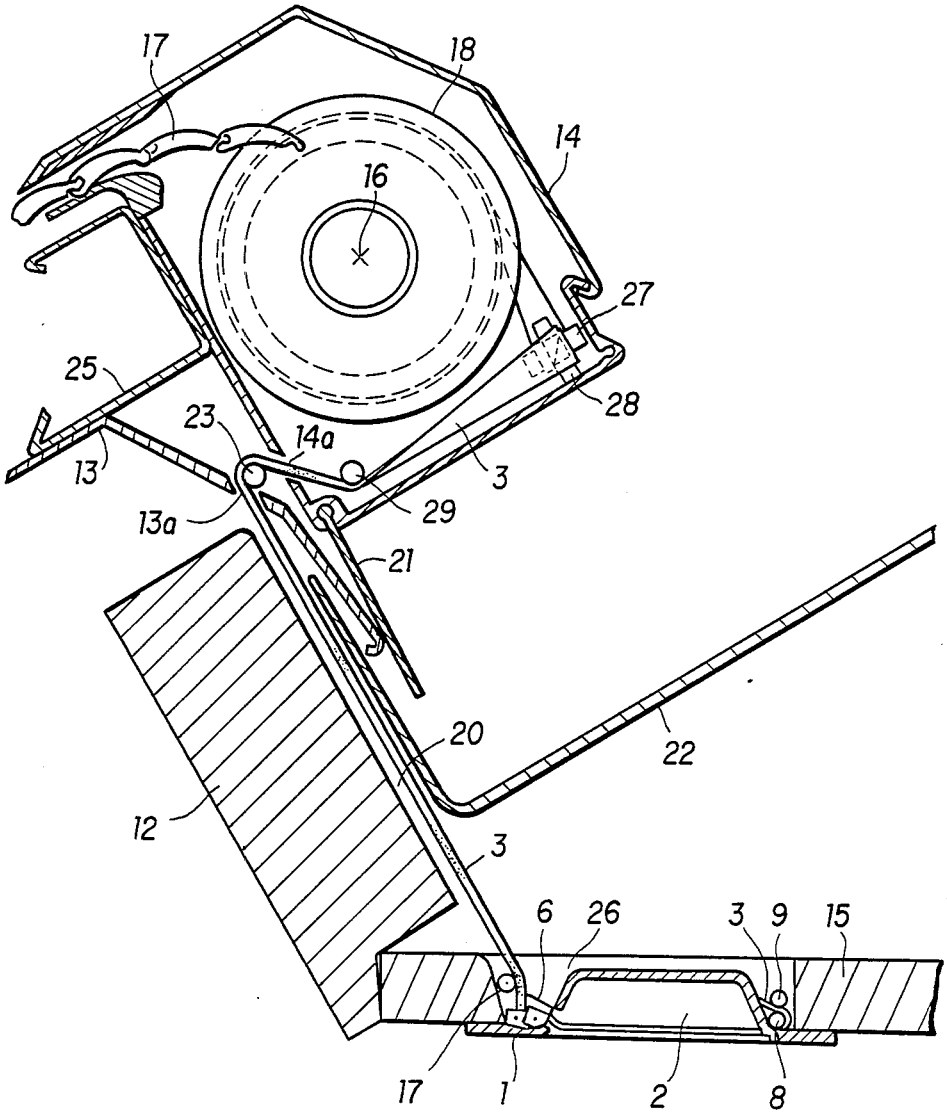
FIG. 3 shows a diagrammatic sectional view of the arrangement of the strap winder on a skylight provided with a roller blind.

In FIG. 3, the strap winder is installed on a skylight provided with a roller blind, the frame upper piece 12 of the skylight bearing an awning compartment 13 with a strap opening 13*a*, the compartment having a cover part 22 engaging underneath it. On the awning compartment 3, a roller blind compartment 14 is fixed via a support rail 25 connected to the latter. In the roller blind compartment 14 there is arranged a strap drum 18 coaxially connected to a rotatably mounted winding shaft 16 for the roller blind 17. The pulling strap 3 fixed to the latter runs via a plurality of strap deflection rollers 27, 28 and 29, rotatably mounted in the roller blind compartment 14, to a rotatably mounted strap deflection roller 23, which is aligned with the strap opening 13*a* of the awning compartment 13 and the gap 20 between the frame upper piece 12 and the cover part 22. The pulling strap 3 runs from the strap deflection roller 23 through the gap 20 in a straight line to the strap guide roller 7 of the strap winder arranged in a recess 26 of a skylight lining 15 and from there through the strap clamping device 6 transversely over the recessed grip 2 and then via the strap deflection roller 8, 9 and 10 to the strap drum 11. FIG. 1 illustrates well that this arrangement of the strap winder means that only a relatively short pulling strap 3 is required, so that the diameter of the strap drum 11 of the strap winder and of the strap drum 18 of the roller blind compartment can be kept small. At the same time, a convenient operation of the section of the pulling strap 3 stretching over the recessed grip 2 is also ensured when the window casement is open. As the strap opening 13*a* is sealed off on all sides by the roller blind compartment 14 and a flexible seal arranged on the latter, any ingress of rainwater, blown snow etc. into the gap 20 is also reliably prevented.

The strap winder described above with reference to a preferred embodiment can be appropriately modified in various ways according to the requirements of the individual case by a person skilled in the art, provided that the laterally adjacent arrangement of strap drum 11 and recess grip 2 and the arrangement of the strap clamping device 6 on the side of the recessed grip 2 facing the roller blind in strap direction are preserved.

What is claimed is:

1. A strap winder, in particular for skylight roller blinds, having a strap drum (11) pretensioned by spring force in winding direction having a pulling strap (3) running through a first strap opening and having a strap clamping device (6) arranged close to the first strap opening (4), the strap drum being rotatably mounted on the rear of a base plate (1) about an axis of rotation substantially perpendicular to the latter, wherein (a) in the base plate (1) there is provided a frontal recessed grip (2), laterally alongside the strap drum (11), (b) on opposite sides of the recessed grip (2), the first and a second strap opening (4 and 5, respectively), for the pulling strap (3) passing transversely through the recessed grip (2), are fitted, (c) on the rear of the base plate (1), close to the second strap opening (5), at least one strap deflection roller (8, 9, 10) for the deflection and reversing of the pulling strap (3) to the strap drum (11) is rotatably mounted, (d) the strap plane of the pulling strap passing through being guided substantially perpendicular to the axis of rotation of the strap drum.

2. A strap winder as claimed in claim 1, wherein the base plate (1) is designed for installation with upwardly facing rear on a wall directly above the skylight or on a window lining.

3. A strap winder as claimed in claim 1 or 2, wherein at least one strap guide roller (7) for the strap section running from the strap clamping device (6) to the roller blind is rotatably mounted on the rear of the base plate (1).

4. A strap winder as claimed in claim 1, wherein the strap section passing through the recessed grip (2) runs transversely to the joining line of the center points of recessed grip (2) and strap drum (11).

5. A strap winder as claimed in claim 1, wherein the axis of rotation of at least one strap deflection roller (8, 9) runs obliquely at a predetermined angle with respect to the strap section passing through the recessed grip (2).

6. A strap winder as claimed in claim 1, wherein at least one strap deflection roller (10), guiding the pulling strap (3) obliquely over a rear corner region of the recessed grip (2), is rotatably mounted between the strap drum (11) and a strap deflection roller (8, 9) fitted close to the second strap opening (5).

* * * * *